US008545057B2

(12) United States Patent
Igaki

(10) Patent No.: US 8,545,057 B2
(45) Date of Patent: Oct. 1, 2013

(54) LED LIGHTING DEVICE

(75) Inventor: Masaru Igaki, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 275 days.

(21) Appl. No.: 13/041,936

(22) Filed: Mar. 7, 2011

(65) Prior Publication Data

US 2011/0215739 A1 Sep. 8, 2011

(30) Foreign Application Priority Data

Mar. 8, 2010 (JP) ..... 2010-050144
Jun. 9, 2010 (JP) ..... 2010-131778
Jan. 28, 2011 (JP) ..... 2011-016064

(51) Int. Cl.
*F21S 4/00* (2006.01)
*F21V 23/00* (2006.01)
*F21V 13/04* (2006.01)

(52) U.S. Cl.
USPC ..... 362/249.06; 362/236; 362/246; 362/247; 362/249.05

(58) Field of Classification Search
USPC ..... 362/249.02, 249.05, 249.06, 545, 362/235–237, 246, 247
See application file for complete search history.

(56) References Cited

U.S. PATENT DOCUMENTS 6,220,722 B1 * 4/2001 Begemann ..... 362/231
6,523,978 B1 * 2/2003 Huang ..... 362/249.04
6,547,410 B1 * 4/2003 Pederson ..... 362/35
6,578,979 B2 * 6/2003 Truttmann-Battig ..... 362/92
6,789,930 B2 * 9/2004 Pederson ..... 362/545
6,942,361 B1 * 9/2005 Kishimura et al. ..... 362/240
6,994,452 B2 * 2/2006 Rozenberg et al. ..... 362/183
7,585,090 B2 * 9/2009 Wu ..... 362/249.02
7,637,636 B2 * 12/2009 Zheng et al. ..... 362/294
7,703,949 B2 * 4/2010 Lai ..... 362/294
7,922,363 B2 * 4/2011 Yang et al. ..... 362/294
7,967,469 B2 * 6/2011 Fang et al. ..... 362/249.02
8,235,539 B2 * 8/2012 Thomas et al. ..... 362/92
2004/0114367 A1 * 6/2004 Li ..... 362/248
2009/0237931 A1 9/2009 Liu et al.

FOREIGN PATENT DOCUMENTS

CN 201145173 Y 11/2008
CN 101498419 A 8/2009
JP 2007-87798 4/2007

* cited by examiner

*Primary Examiner* — Alan Cariaso
(74) *Attorney, Agent, or Firm* — Hamre, Schumann, Mueller & Larson, P.C.

(57) ABSTRACT

An LED lighting device includes a plurality of LED chips and a pair of side mounting faces. The distance between the side mounting faces becomes smaller from the base side toward the extremity side in the x direction. The side mounting faces face mutually opposite sides in the y direction. Also, the distance between the side mounting faces becomes shorter from the back side toward the front side in the z direction that is perpendicular to both the x direction and the y direction. The plurality of LED chips include LED chips mounted on the pair of side mounting faces. The LED lighting device illuminates an illumination target with a uniform illuminance distribution.

24 Claims, 19 Drawing Sheets

(R1) $\theta = 20^\circ$ $\alpha = 55^\circ$ $\beta = 0^\circ$ (R2) $\theta = 20^\circ$ $\alpha = 111^\circ$ $\beta = 0^\circ$ (R3) $\theta = 20^\circ$ $\alpha = 38^\circ$ $\beta = 0^\circ$ $\theta = 20^\circ$ $\alpha = 38^\circ$ $\beta = 40^\circ$

LED LIGHTING DEVICE

BACKGROUND OF THE INVENTION

1. Field of the Invention

The present invention relates to an LED lighting device.

2. Description of Related Art

FIG. 30 shows an example of a conventional lighting device (see, for example, JP 2007-87798 A). A lighting device 900 shown in FIG. 30 is mounted on a utility pole 852 installed in a road 851 and is used as a streetlight or a security light. The lighting device 900 is provided with a fluorescent lamp as alight source.

The lighting device 900 is constantly on during nighttime. For this reason, it is desirable that the lighting device 900 consumes less power. It is also desirable that the lighting device 900 is capable of lighting a wide range on the road 851 with a uniform illuminance. Furthermore, the lighting device 900 is installed in a relatively high location, and the task of replacing the light source (fluorescent lamp) is cumbersome. It is therefore desirable to reduce the frequency of replacing the light source as much as possible.

SUMMARY OF THE INVENTION

The present invention has been conceived under the above-described circumstances. It is an object of the present invention to provide an LED lighting device that enables a reduction of power consumption and a uniform illuminance distribution as well as achieving a reduction of the frequency of replacing the light source.

An LED lighting device provided according to a first aspect of the present invention includes a plurality of LED chips and a pair of first side mounting faces. The pair of first side mounting faces are configured such that a distance between the first side mounting faces becomes shorter from a base side toward an extremity side in a first direction, that the first side mounting faces face mutually opposite sides in a second direction that is perpendicular to the first direction, and that the distance between the first side mounting faces becomes shorter from a back side toward a front side in a third direction that is perpendicular to both the first and second directions. The plurality of LED chips include LED chips belonging to a pair of first side lighting groups mounted on the pair of first side mounting faces.

Preferably, the LED lighting device according to the first aspect further includes a pair of second side mounting faces. The pair of second side mounting faces are configured such that a distance between the second side mounting faces becomes shorter from the base side toward the extremity side in the first direction, that the second side mounting faces face mutually opposite sides in the second direction, and that the distance between the second side mounting faces becomes shorter from the back side toward the front side in the third direction. Also, the pair of second side mounting faces are positioned on the base side in the first direction relative to the pair of first side mounting faces. Furthermore, a distance between extremities of the pair of second side mounting faces is shorter than a distance between bases of the pair of first side mounting faces. The plurality of LED chips include LED chips belonging to a pair of second side lighting groups mounted on the pair of second side mounting faces.

Preferably, the LED lighting device according to the first aspect further includes a front mounting face that is positioned between the pair of first side mounting faces in the second direction and that faces the front side in the third direction. The plurality of LED chips include LED chips belonging to a front lighting group mounted on the front mounting face.

Preferably, the LED lighting device according to the first aspect further includes a mounting bracket having the pair of first side mounting faces and the front mounting face.

Preferably, the LED lighting device according to the first aspect further includes a power source unit for lighting the plurality of LED chips. The mounting bracket has a hollow portion positioned on the back side relative to the front lighting group in the third direction, and the power source unit is housed in the hollow portion.

Preferably, the mounting bracket is made up of a metal plate bent at interfaces between the pair of first side mounting faces and the front mounting face.

Preferably, the LED lighting device according to the first aspect further includes a power source unit for lighting the plurality of LED chips. The power source unit is disposed on the base side in the first direction relative to the pair of second side mounting faces.

Preferably, the LED lighting device according to the first aspect further includes a plurality of first side LED units attached to each of the first side mounting faces. The first side LED units each include the LED chips belonging to the corresponding one of the first side lighting groups and a strip-shaped substrate on which the LED chips are mounted in a linear manner.

Preferably, the first side LED units each include a pair of reflectors disposed so as to sandwich the LED chips belonging to the corresponding one of the first side lighting groups in a width direction of the substrate.

Preferably, the LED lighting device according to the first aspect further includes a front LED unit attached to the front mounting face. The front LED unit includes the LED chips belonging to the front lighting group and a strip-shaped substrate on which the LED chips are mounted in a linear manner.

Preferably, the front LED unit includes a pair of reflectors disposed so as to sandwich the LED chips belonging to the front lighting group in a width direction of the substrate.

Preferably, the LED lighting device according to the first aspect further includes a light transmitting cover that houses the pair of first side mounting faces and that transmits light from the plurality of LED chips.

Preferably, the LED lighting device according to the first aspect further includes an attachment face that is positioned on the base side in the first direction relative to the pair of first side mounting faces and in which a distance between the attachment face and the pair of side mounting faces becomes shorter toward the back side in the third direction.

Preferably, the LED lighting device according to the first aspect further includes a lighting controller that, for each of the first side lighting groups, adjusts an amount of light emitted from the plurality of LED chips.

Preferably, the LED lighting'device according to the first aspect further includes a lighting controller that, for each of the first side lighting groups, the second side lighting groups and the front lighting group, adjusts an amount of light emitted from the plurality of LED chips.

Preferably, the LED lighting device according to the first aspect further includes a lighting controller that, for each of the first side lighting groups, the second side lighting groups and the front lighting group, adjusts an amount of light emitted from the plurality of LED chips.

Preferably, the light transmitting cover has a light-diffusing face.

An LED lighting device according to a second aspect of the present invention includes a plurality of LED chips, a plurality of mounting faces facing different directions, and a lighting controller. The plurality of LED chips are grouped so as to each belong to any one of a plurality of lighting groups respectively mounted on the plurality of mounting faces. The lighting controller is configured to adjust, for each of the lighting groups, an amount of light emitted from the plurality of LED chips.

Preferably, the plurality of mounting faces are elongated in a first direction and face different directions from each other as viewed in the first direction.

Preferably, the plurality of mounting faces include a pair of first side mounting faces. The first side mounting faces are configured such that a distance between the first side mounting faces becomes shorter from a base side toward an extremity side in a first direction, that the first side mounting faces face mutually opposite sides in a second direction that is perpendicular to the first direction, and that the distance between the first side mounting faces becomes shorter from a back side toward a front side in a third direction that is perpendicular to both the first and second directions.

Preferably, the plurality of mounting faces include a pair of second side mounting faces. The second side mounting faces are configured such that a distance between the second side mounting faces becomes shorter from the base side toward the extremity side in the first direction, that the second side mounting faces face mutually opposite sides in the second direction, and that the distance between the second side mounting faces becomes shorter from the back side toward the front side in the third direction. The pair of second side mounting faces are positioned on the base side in the first direction relative to the pair of first side mounting faces. A distance between extremities of the pair of second side mounting faces is shorter than a distance between bases of the pair of first side mounting faces.

Preferably, the plurality of mounting faces include a front mounting face. The front mounting face is positioned between the pair of first side mounting faces in the second direction and faces the front side in the third direction.

Preferably, at least two lighting groups from among the plurality of lighting groups are arranged in the first direction on at least one mounting face from among the plurality of mounting faces.

Preferably, the LED lighting device according to the second aspect further includes a plurality of LED units attached to each of the mounting faces. The LED units each include a plurality of LED chips belonging to any one of the lighting groups and a strip-shaped substrate on which the LED chips are mounted in a linear manner.

Preferably, the LED units each include a pair of reflectors disposed so as to sandwich the plurality of LED chips belonging to any one of the lighting groups in a width direction of the substrate.

Preferably, the LED lighting device according to the second aspect further includes a mounting bracket having the plurality of mounting faces, a support bracket that supports the mounting bracket, and an attachment bracket that holds the support bracket. The attachment bracket has an attachment face on a base side in the first direction and is configured to hold the support bracket such that an attachment orientation of the support bracket with respect to the attachment face can be changed.

Preferably, the LED lighting device according to the second aspect further includes a light transmitting cover that houses the plurality of mounting faces and that transmits light from the plurality of LED chips.

Preferably, the light transmitting cover has a light-diffusing face.

Other features and advantages of the present invention will be more apparent from the following description of exemplary embodiments of the invention.

DETAILED DESCRIPTION OF THE PREFERRED EMBODIMENTS

Figure 1:
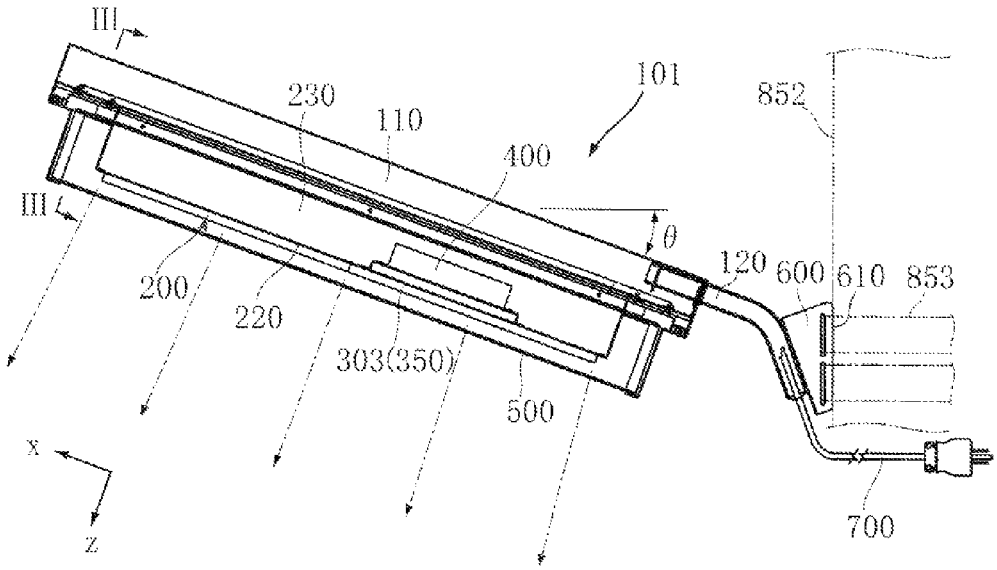
FIG. 1 is a cross-sectional view of an LED lighting device according to a first embodiment of the present invention.
Figure 2:
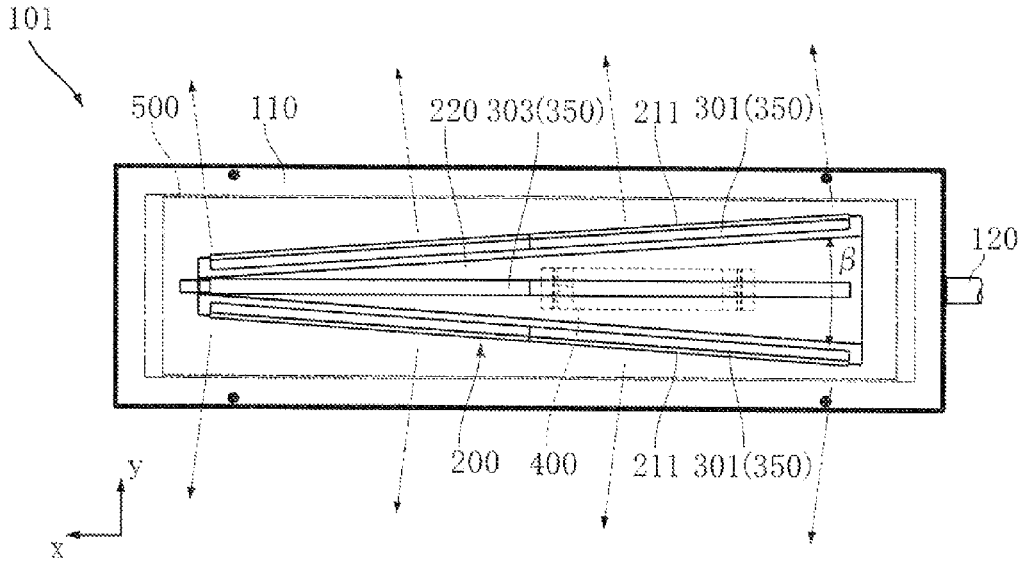
FIG. 2 is a diagram of the LED lighting device according to the first embodiment of the present invention as viewed from the front side thereof.
Figure 3:
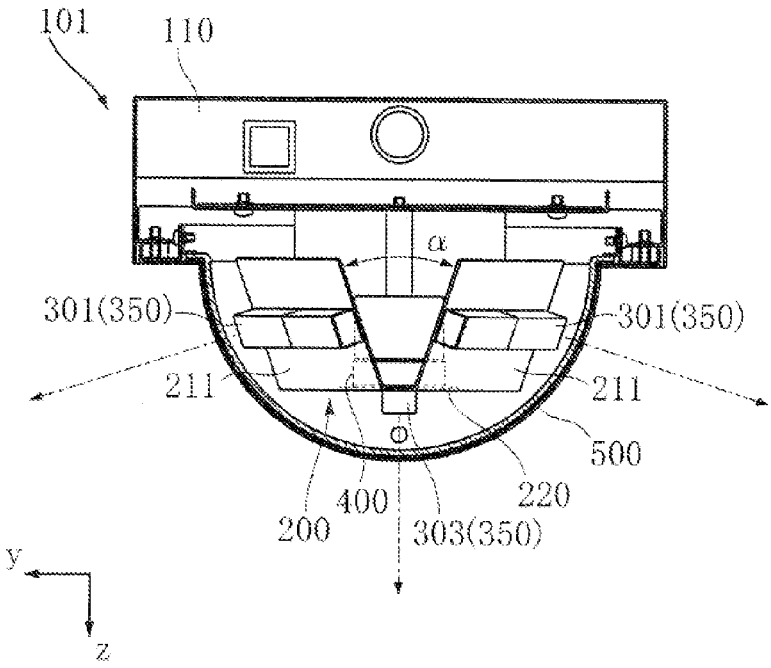
FIG. 3 is a cross-sectional view taken along the line III-III of FIG. 1.

FIGS. 1 to 3 show an LED lighting device according to a first embodiment of the present invention. An LED lighting device 101 according to the present embodiment includes a support bracket 110, a support arm 120, a mounting bracket 200, a pair of side LED units 301, a front LED unit 303, a power source unit 400, a light transmitting cover 500 and an attachment bracket 600. The LED lighting device 101 is used as, for example, a streetlight or a security light. In the present embodiment, the LED lighting device 101 has a length (x direction dimension) of approximately 700 mm (excluding the support arm 120), a width (y direction dimension) of approximately 200 mm and a height (z direction dimension) of approximately 140 mm.

The support bracket 110 supports the mounting bracket 200 and the light transmitting cover 500. The support bracket 110 has an elongated shape extending in the x direction, and it can be formed by, for example, bending a metal plate made of stainless steel having a thickness of approximately 1 mm. The support arm 120 is attached to the base side in the x direction of the support bracket 110 (to the end close to the power source unit 400), and it can be formed by, for example, bending a stainless steel pipe. A power cord 700 extends from the support arm 120. The power cord 700 is provided to receive power from, for example, a commercial power source (100 V, 200 V or the like).

The attachment bracket 600 holds the support bracket 110 via the support arm 120, and it can be formed by, for example, bending a metal plate made of stainless steel having a thickness of approximately 1.5 mm. The attachment bracket 600 is attached to a utility pole 852 with the use of, for example, a band 853, and thereby the LED lighting device 101 is fixed to the utility pole 852. The attachment bracket 600 has an attachment face 610 that abuts the utility pole 852. The orientation of the LED lighting device 101 with respect to the utility pole 852 is defined by appropriately positioning the attachment face 610 to the utility pole 852. In the present embodiment, the angle θ between the lengthwise direction (x direction) of the support bracket 110 and the horizontal direction is set to 20°.

The mounting bracket 200 is a bracket to which the pair of side LED units 301 and the front LED unit 303 are mounted, and is fixed to the support bracket 110. The mounting bracket 200 can be formed by, for example, bending a metal plate made of a stainless steel having a thickness of approximately 1 mm. The mounting bracket 200 has a pair of side mounting faces 211 and a front mounting face 220. The pair of side mounting faces 211 are elongated flat faces extending in the x direction as a whole. The space surrounded by the pair of side mounting faces 211 and the front mounting face 220 is a hollow portion 230.

As shown in FIG. 3, the pair of side mounting faces 211 face mutually opposite sides in the y direction. In the z direction, the distance between the pair of side mounting faces 211 becomes shorter from the back side (the upper side in the diagram) toward the front side (the lower side in the diagram). In the present embodiment, the angle α between the pair of side mounting faces 211 in the yz plane is set to 38°.

As shown in FIG. 2, the distance between the pair of side mounting faces 211 in the y direction becomes shorter from the base side in the x direction (the right side in the diagram) toward the extremity side (the left side in the diagram). The angle β between the pair of side mounting faces 211 in the xy plane is set to approximately 8° in the illustrated configuration, but the angle β is not limited to this angle. As will be described later, the angle β may be set to, for example, approximately 40° in order to achieve a uniform illuminance distribution.

The front mounting face 220 is positioned between the pair of side mounting faces 211, and has a long triangular shape extending in the x direction. The front mounting face 220 faces the front side in the z direction.

The pair of side LED units 301 each have an elongated shape extending in the x direction, and the side LED units 301 are mounted on the pair of side mounting faces 211, respectively. The front LED unit 303 has an elongated shape extending in the x direction, and is mounted on the front mounting face 220.

Figure 4:
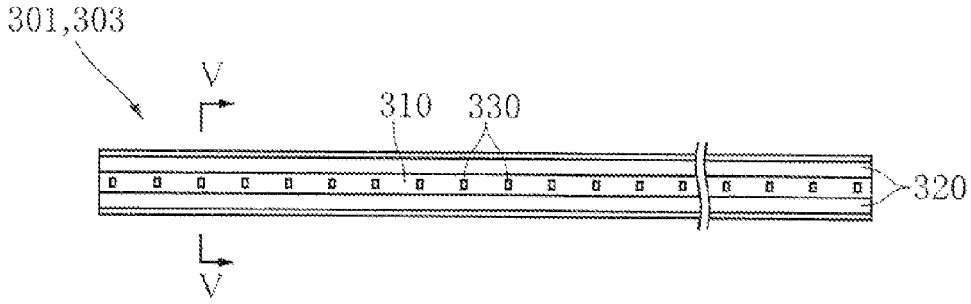
FIG. 4 is a plan view of an LED unit used in the LED lighting device according to the first embodiment of the present invention.
Figure 5:
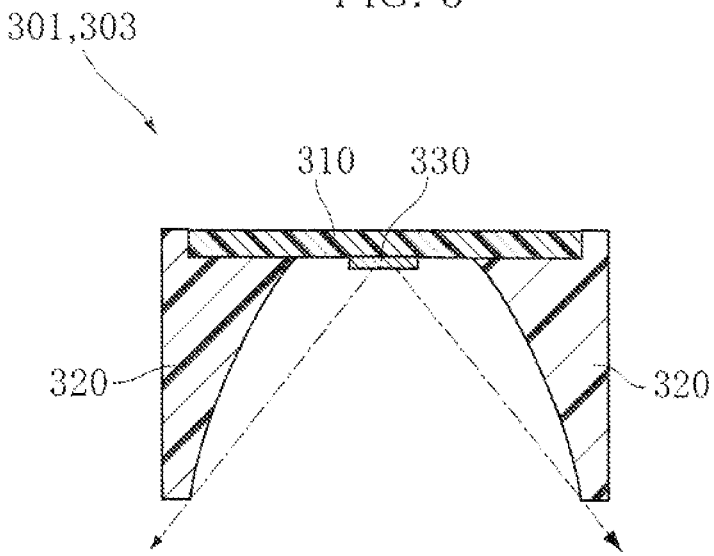
FIG. 5 is a cross-sectional view taken along the line V-V of FIG. 4.

In the present embodiment, the side LED units 301 and the front LED unit 303 have the same configuration. As shown in FIGS. 4 and 5, the units 301 and 303 each include a substrate 310, a pair of reflectors 320 and a plurality of LED modules 330. The substrate 310 has a strip shape, and is formed by forming, for example, a wiring pattern on a substrate made of glass epoxy resin. The pair of reflectors 320 are made of, for example, a resin, and are provided along the widthwise ends of the substrate 310. Each reflector 320 has an inner face that has undergone aluminum vapor deposition and thus has a high reflectivity. The plurality of LED modules 330 are arranged in a line along the lengthwise direction of the substrate 310. In the present embodiment, the pitch of the arrangement of the plurality of LED modules 330 is 14.5 mm. The angle of divergence of light emitted from the side LED units 301 and the front LED unit 303 (see FIG. 5) is approximately 70°.

Figure 6:
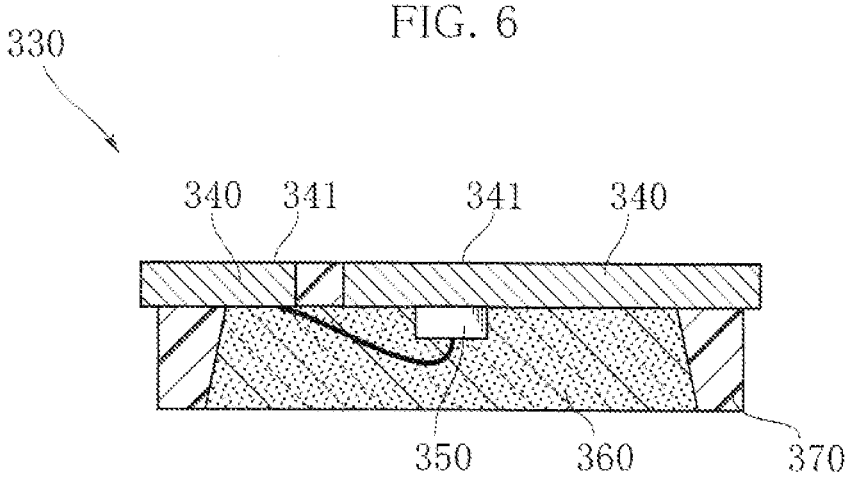
FIG. 6 is a cross-sectional view of an LED module used in the LED unit shown in FIG. 5.

As shown in FIG. 6, each LED module 330 includes a pair of leads 340, an LED chip 350, a sealing resin 360 and a reflector 370. The pair of leads 340 are made of, for example, a Cu alloy. In the example shown in FIG. 6, the LED chip 350 is mounted on the underside of the right-side lead 390. The LED chip 350 is connected to the underside of the left-side lead 340 via a wire. The upper face of each lead 340 (the face opposite to where the LED chip 350 is positioned) serves as a mounting terminal 341 used to surface-mount the LED module 330. The LED chip 350 is the light source for the LED module 330, and is configured to emit, for example, blue light.

The sealing resin 360 protects the LED chip 350. The sealing resin 360 is made of a light transmitting resin containing a phosphor material. The phosphor material emits yellow light by being excited by the light (blue light) emitted from the LED chip 350. The LED module 330 can thereby project white light. Instead of the phosphor material that emits yellow light, a mixture of a phosphor material that emits red light and a phosphor material that emits green light may be used. The reflector 370 is a frame-shaped member surrounding the LED chip 350, and can be made of, for example, a white resin. The reflector 370 reflects the light emitted from the LED chip 350 towards sides in a specific direction. In the example shown in FIG. 6, the reflector 370 reflects the light emitted from the LED chip 350 downward.

As can be understood from the above description, a plurality of LED chips 350 are used in the LED lighting device 101. Specifically, LED chips used in the side LED units 301 ("LED chips belonging to the side lighting group") and LED chips used in the front LED unit 303 ("LED chips belonging to the front lighting group") are used.

The power source unit 400 converts alternating current electric power received via the power cord 700 to direct current electric power suitable to light the LED chips 350. In the present embodiment, the power source unit 400 is housed in the hollow portion 230, and is attached to the back side portion of the mounting bracket 200 (a portion in the face opposite to the front mounting face 220). In the present embodiment, the total power consumption of the pair of side LED units 301 and the front LED unit 303 is approximately 18 W.

The light transmitting cover 500 transmits the light emitted from the side LED units 301 and the front LED unit 303 (see FIG. 3) while protecting these units. The light transmitting cover 500 is made of, for example, a transparent resin, and has a semicircular cross section.

The actions of the LED lighting device 101 will be described next.

Figure 7:
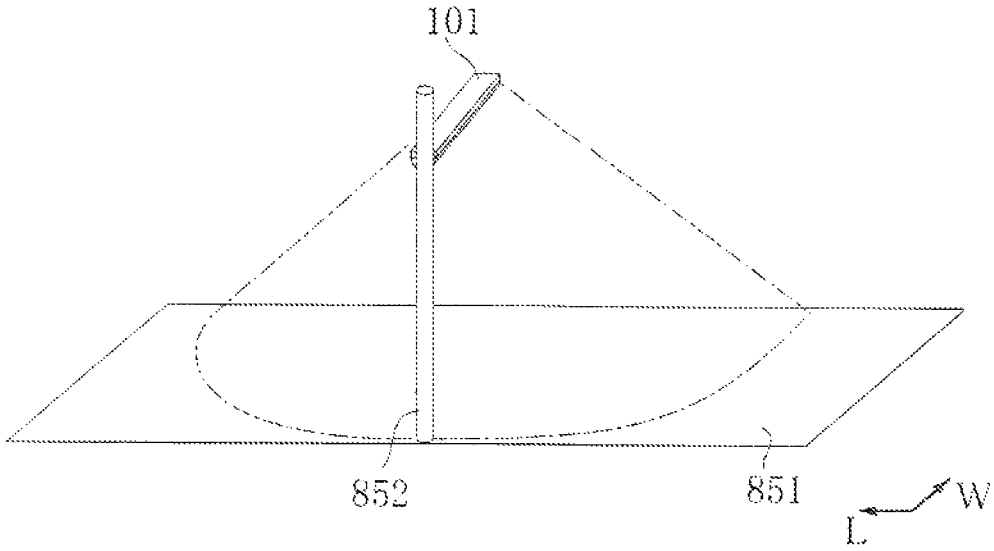
FIG. 7 is an illustrative diagram showing use of the LED lighting device according to the first embodiment of the present invention.
Figure 8:
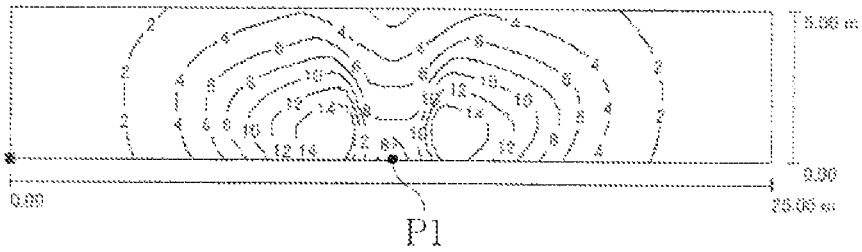
FIG. 8 is a diagram showing an illuminance distribution of Reference Example 1.
Figure 9:
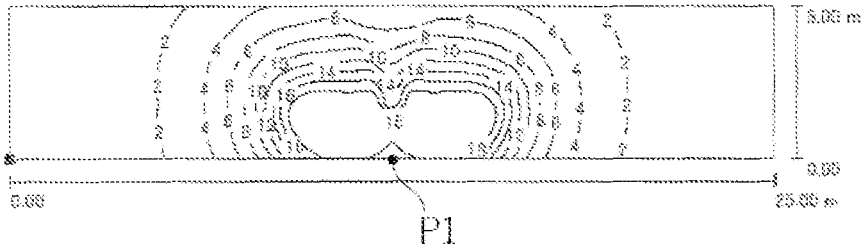
FIG. 9 is a diagram showing an illuminance distribution of Reference Example 2.
Figure 10:
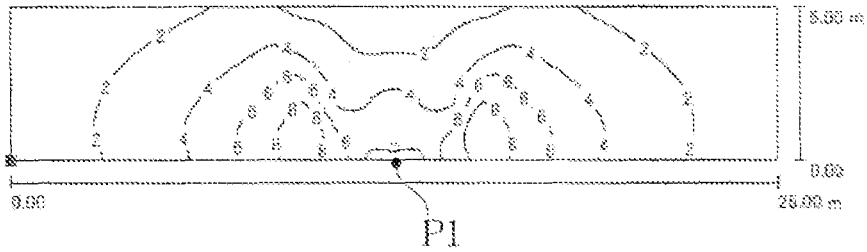
FIG. 10 is a diagram showing an illuminance distribution of Reference Example 3.
Figure 11:
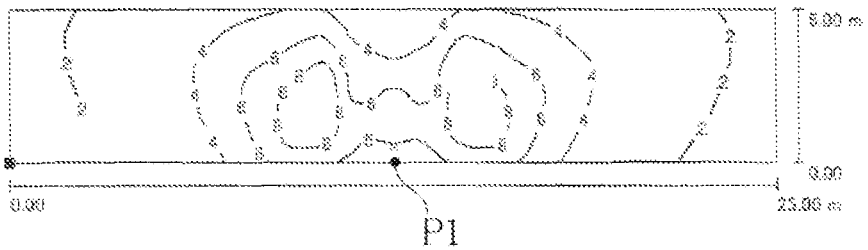
FIG. 11 is a diagram showing an illuminance distribution of the LED lighting device according to the first embodiment of the present invention.

FIG. 7 shows an example of use of the LED lighting device 101. In this diagram, the LED lighting device 101 is attached to a utility pole 852 installed in a road 851. The LED lighting device 101 is attached at a height from the road 851 of, for example, approximately 4.5 m. FIGS. 8 to 11 show results of simulation of the illuminance distribution on the road 851 in the above-described attachment state (refer to FIGS. 1, 3 and 2 for illustration of the angle θ, the angle α and the angle β, respectively). FIG. 8 shows the result of Reference Example 1, with the angle θ=20°, the angle α=55°, and the angle β=0°. FIG. 9 shows the result of Reference Example 2, with the angle θ=20°, the angle α=111°, and the angle β=0°. FIG. 10 shows the result of Reference Example 3, with the angle θ=20°, the angle α=38°, and the angle β=0°. FIG. 11 shows the result of the LED lighting device 101 of the present embodiment, with the angle θ=20° the angle α=38°, and the angle β=40°. The black dot indicated by P1 in each diagram shows the installed location of the utility pole 852. The road 851 has a width of 5 m and a length of 25 m. Reference Examples 1 to 3 and the present embodiment have the same angle θ of 20°.

As shown in FIG. 8, in the result of Reference Example 1, two illuminance peaks of a relative illuminance of 14 or more are observed near the utility pole 852. On the other hand, relatively dark regions with a relative illuminance of 2 or less are observed in the portions close to the edges in the lengthwise direction of the road 851. As shown in FIG. 9, in the case of the angle α being 111°, illuminance peaks of a relative illuminance of 18 or more are observed, indicating that the illumination is significantly bright. As shown in FIG. 10, in the case of the angle α being 38°, the relative illuminance of illuminance peaks is reduced to 8 or more. Also, the area of the regions of a relative illuminance of 2 or less is reduced. However, illuminance peaks in the width direction of the road 851 are at a position very close to the utility pole 852. Presumably, a large amount of light is escaping to the back side of the utility pole 852 in the width direction of the road 851.

On the other hand, as shown in FIG. 11, with the LED lighting device 101 of the present embodiment, illuminance peaks are observed close to the center in the width direction of the road 851. Accordingly, it is possible to suppress improper illumination of the ground and buildings (for example, houses) behind the utility pole 852. Also, the area of the regions of a relative illuminance of 2 or less is further reduced, and the spacing between contour lines (isoilluminance lines) is increased. This indicates that the illuminance distribution on the road 851 is significantly uniform.

In the present embodiment, the light from the pair of side LED units 301 is dispersed in the lengthwise direction of the road 851 by setting the angle α to 38°. Also, by setting the angle β to 40°, the light from the pair of side LED units 301 is directed toward the center in the width direction of the road 851. With such settings, a uniform illuminance distribution as described above is achieved.

Furthermore, inclusion of the front LED unit 303 can appropriately prevent insufficient illuminance in the region of the road 851 immediately below the LED lighting device 101. The front LED unit 303 may be omitted in the case of using a pair of side LED units 301 having a larger angle of divergence of light.

The mounting bracket 200 is formed by bending a metal plate. This method is appropriate in that the side mounting faces 211 and the front mounting face 220 can each be formed into a flat face facing a desired range and also in that a large-capacity hollow portion 230 can be formed. Also, by housing the power source unit 400 in the hollow portion 230, the size of the LED lighting device 101 can be reduced.

A plurality of the LED chips 350 can be easily arranged on the mounting bracket 200 by using the side LED units 301 and the front LED unit 303.

The LED chips 350 have a longer service life than fluorescent lamps (or in other words, they can properly emit light for a longer period of time). Accordingly, the frequency of replacing the LED lighting device 101 can be reduced significantly as compared to the case where fluorescent lamps are used. Also, use of the LED chips 350 can reduce the power consumption of the LED lighting device 101 to approximately 18 W.

FIGS. 12 to 29 show other embodiments of the present invention. In these diagrams, the same reference numerals as those in the above-described embodiment are given to elements that are the same or similar to those of the above-described embodiment.

Figure 12:
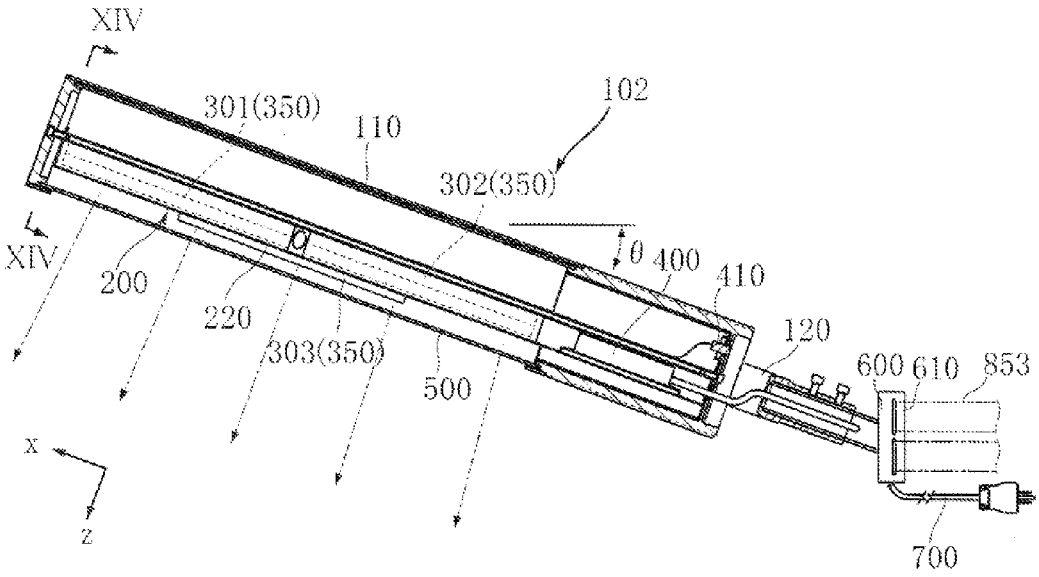
FIG. 12 is a cross-sectional view of an LED lighting device according to a second embodiment of the present invention.
Figure 13:
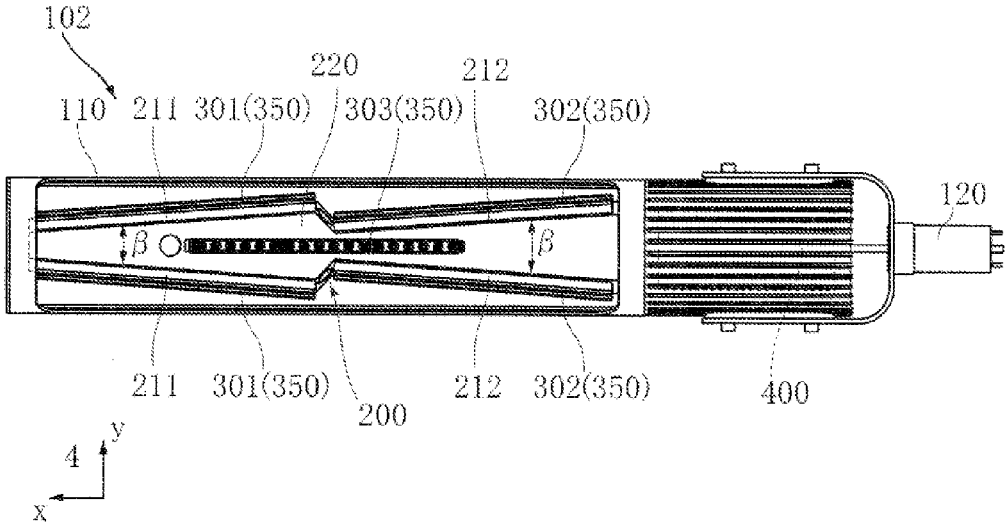
FIG. 13 is a diagram of the LED lighting device according to the second embodiment of the present invention as viewed from the front side thereof.
Figure 14:
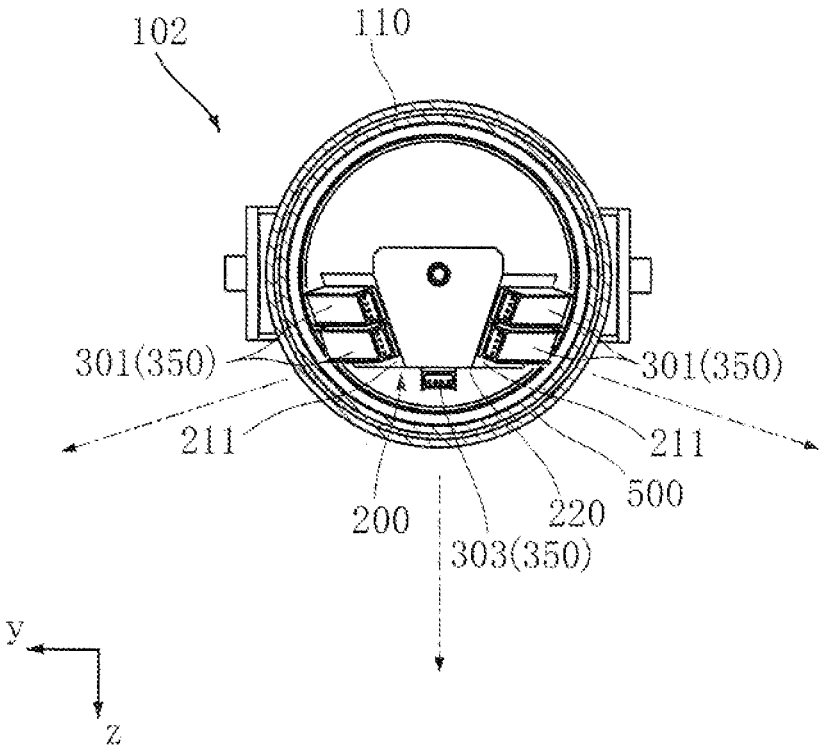
FIG. 14 is a cross-sectional view taken along the line XIV-XIV of FIG. 12.

FIGS. 12 to 14 show an LED lighting device according to a second embodiment of the present invention. An LED lighting device 102 of the present embodiment is different from that of the above embodiment primarily in that a pair of side mounting faces 212 and a plurality of side LED units 302 are added.

In the present embodiment, a mounting bracket 200 has a pair of side mounting faces 211 and a pair of side mounting faces 212. The pair of side mounting faces 212 face mutually opposite sides in the y direction. The distance between the pair of side mounting faces 212 in the z direction becomes shorter from the back side (the upper side in FIG. 14) toward the front side (the lower side in FIG. 14). In the present embodiment, the angle α (see FIG. 3) between the pair of side mounting faces 212 in the yz plane is set to 38°. As shown in FIG. 13, the distance between the pair of side mounting faces 212 in the y direction becomes shorter from the base side in the x direction (the right side in the diagram) toward the extremity side (the left side in the diagram). The angle β between the pair of side mounting faces 212 in the xy plane is set to approximately 8° in the illustrated configuration. The angle β is not limited to this angle, and an angle β of approximately 40° is suitable to achieve a uniform illuminance distribution, which will be described later.

As shown in FIG. 13, the pair of side mounting faces 212 are positioned on the base side in the x direction relative to the pair of side mounting faces 211. The spacing between the extremities of the pair of side mounting faces 212 in the x direction is shorter than the spacing between the bases of the pair of side mounting faces 211 in the x direction. In the present embodiment, the dimensions of each of the side mounting faces 211 and their relative positional relationship are the same as those of the pair of side mounting faces 212.

Two side LED units 301 are mounted parallel to each other on each side mounting face 211, and two side LED units 302 are mounted parallel to each other on each side mounting face 212. The side LED units 302 have the same configuration as that of the side LED units 301 described with reference to FIGS. 4 to 6.

A front mounting face 220 is provided so as to extend along the pair of side mounting faces 211 and the pair of side mounting faces 212 in the x direction. A front LED unit 303 is disposed so as to overlap a portion of the side LED units 301 and a portion of the side LED units 302 in the x direction. To rephrase it, as viewed in the y direction (see FIG. 12), the front LED unit 303 is disposed so as to partially overlap the side LED units 301 and the side LED units 302.

A support bracket 110 of the present embodiment has a cylindrical portion on the base side, and as shown in FIG. 12, a power source unit 400 is housed in the cylindrical portion. Accordingly, the power source unit 400 is positioned on the base side in the x direction relative to the pair of side mounting faces 212 (in FIG. 13, the power source unit 400 is spaced rightward from the pair of side mounting faces 212). In the present embodiment, an illuminance sensor 410 is attached to the support bracket 110 (see FIG. 12). The illuminance sensor 410 measures the external illuminance through an opening (not shown) provided on the base side in the x direction of the support bracket 110. Particularly, in the present embodiment, the illuminance sensor 410 measures the illuminance of the right-side region in FIG. 12. The illuminance sensor 910 outputs an illuminance signal corresponding to the external illuminance. This illuminance signal is transmitted to the power source unit 400. If, for example, the illuminance signal falls below a preset threshold value, the power source unit 400 performs control to light the side LED units 301 and 302 and the front LED unit 303.

With this embodiment as well, it is possible to achieve a uniform illuminance distribution. Also, by disposing the pair of side mounting faces 211 and the pair of side mounting faces 212 side by side in the x direction, it is possible to reduce the dimension in the y direction of the LED lighting device 102. Specifically, the LED lighting device 101 (see FIG. 2) has a dimension in the y direction of approximately 200 mm, whereas the LED lighting device 102 has a dimension in the y direction of approximately 130 mm. Also, it is effective to dispose the power source unit 400 on the base side in the x direction relative to the pair of side mounting faces 212, in order to reduce the dimension in the y direction of the LED lighting device 102.

The illuminance sensor 410 measures the illuminance of the right-side region of the LED lighting device 102 in FIG. 12. This region is a region where it is difficult for the light from the LED lighting device 102 to reach. For this reason, the results of measurement by the illuminance sensor 410 are less affected by the lighting state of the LED lighting device 102. Accordingly, the LED lighting device 102 can be appropriately lighted when the surroundings become darker than an assumed brightness.

Figure 15:
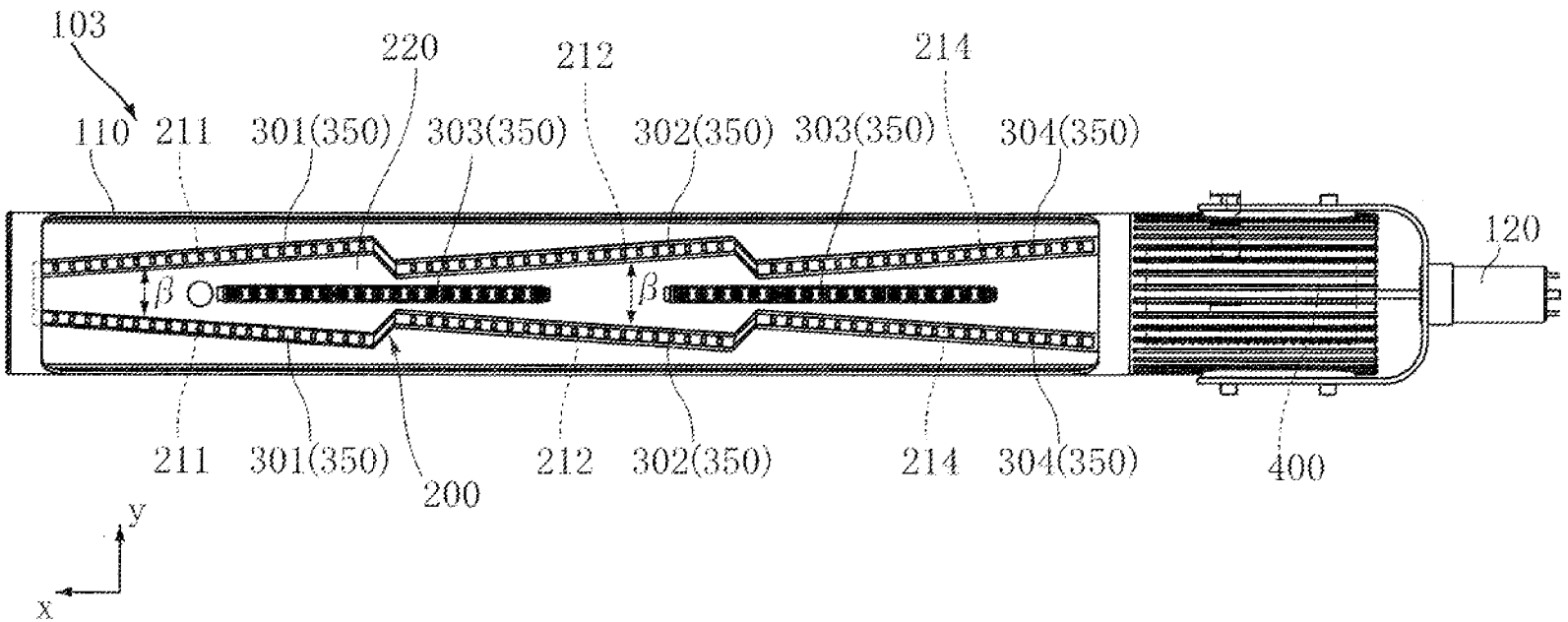
FIG. 15 is a diagram of an LED lighting device according to a third embodiment of the present invention as viewed from the front side thereof.

FIG. 15 shows an LED lighting device according to a third embodiment of the present invention. An LED lighting device 103 of the present embodiment is different from that of the above-described embodiment in that it includes a pair of side mounting faces 214 and a pair of side LED units 304, and that the side LED units 301 and 302 have a configuration different from that of the above-described embodiment.

In the present embodiment, a pair of side mounting faces 214 is further provided on the base side in the x direction relative to the pair of side mounting faces 212. The dimensions of each of the side mounting faces 214 and their relative positional relationship are substantially the same as those of the pairs of side mounting faces 211 and 212.

Figure 16:
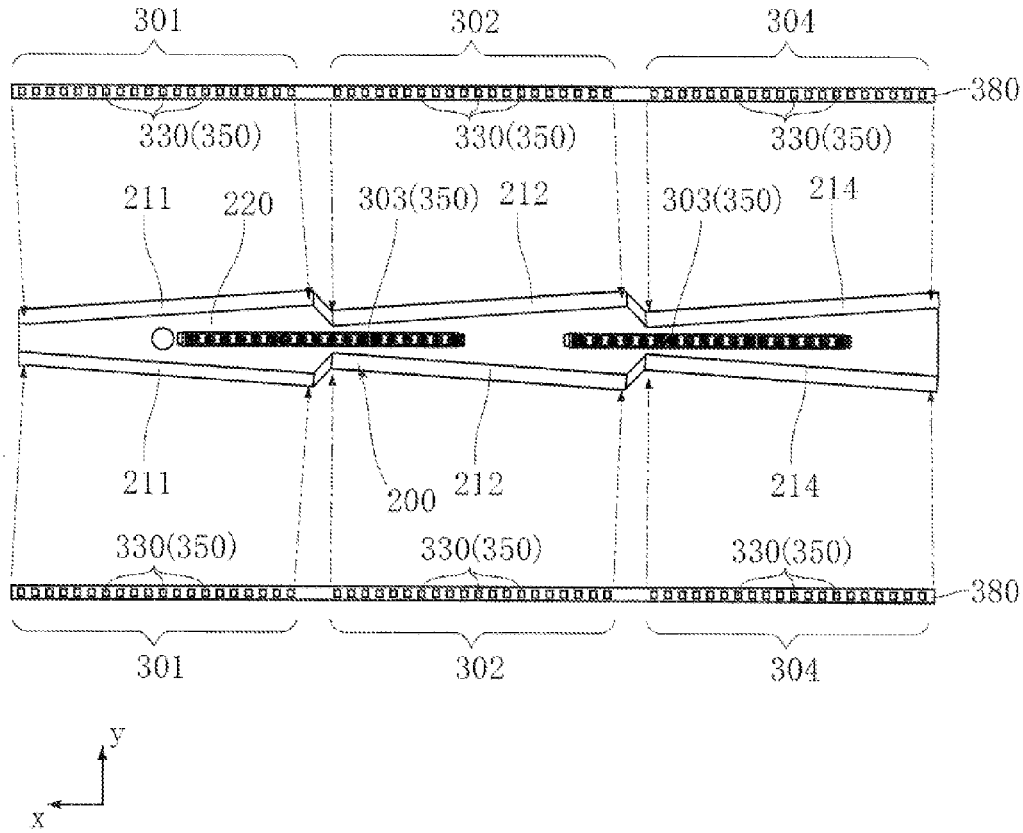
FIG. 16 is a plan view showing a manufacturing process for manufacturing the LED lighting device according to the third embodiment of the present invention.

In the present embodiment, as shown in FIG. 16, a series of side LED units 301, 302 and 304 is formed by a strip-shaped flexible wiring substrate 380 and a plurality of LED modules 330 mounted in a line on the substrate. The side LED unit 301 is formed by an approximately one-third portion on the extremity side (the left side in the diagram) in the x direction of the flexible wiring substrate 380 and a plurality of LED modules 330 mounted on that portion. The side LED unit 302 is formed by an approximately one-third portion substantially centrally disposed in the x direction of the flexible wiring substrate 380 and a plurality of LED modules 330 mounted on that portion. The side LED unit 304 is formed by an approximately one-third portion on the base side (the right side in the diagram) in the x direction of the flexible wiring substrate 380 and a plurality of LED modules 330 mounted on that portion.

In the manufacturing of the LED lighting device 103, a pair of flexible wiring substrates 380 having a plurality of LED modules 330 mounted thereon are bonded to pairs of side mounting faces 211, 212 and 214 of a mounting bracket 200, whereby the side LED units 301, 302 and 304 are respectively mounted on the side mounting faces 211, 212 and 214.

In this embodiment, three pairs of side mounting faces 211, 212 and 214 are provided, whereby the dimension in the y direction of the LED lighting device 103 can be reduced. Also, the side LED units 301, 302 and 304 are formed using a flexible wiring substrate 380, whereby the side LED units 301, 302 and 304 can be easily mounted on the mounting bracket 200 that has a three-tier configuration including the three pairs of side mounting faces 211, 212 and 214.

As can be understood from a comparison of the LED lighting devices 101, 102 and 103, provided that the length in the x direction is the same, the dimension in the y direction can be reduced as the number of side mounting faces is increased. For example, the following method can be used as a method for reasonably achieving such a multiple-tier configuration. Firstly, a flexible wiring substrate 380 (see FIG. 16) is prepared in which a plurality of mounting pads (LED module mounting pads) are arranged at an equal pitch in a line (or a plurality of lines) in the lengthwise direction of the substrate. Each mounting pad is configured such that one LED module 330 can be mounted. To dispose a plurality of LED modules 330 in a multiple-tier configuration, LED modules 330 are mounted only on the mounting pads provided in portions of the flexible wiring substrate 380 that are to be attached to side mounting faces (in other words, no LED modules 330 are mounted on the mounting pads provided in portions between adjacent side mounting faces). After that, the flexible wiring substrate 380 is bonded to each side mounting face. With this method, it is possible to appropriately produce LED lighting devices having different numbers of tiers (different numbers of side mounting faces) using one type of flexible wiring substrate 380.

FIGS. 17 to 21 show an LED lighting device according to a fourth embodiment of the present invention. An LED lighting device 104 of the present embodiment is different from that of the above embodiment primarily in that it includes first to fourth mounting faces 215 to 218, first to fourth LED units 305 to 308, and a lighting controller for adjusting the amount of light for each LED unit.

In the present embodiment, a plurality of front LED units 303 and a plurality of first to fourth LED units 305 to 308 are mounted on a mounting bracket 200, and the mounting bracket 200 is fixed to a support bracket 110. The mounting bracket 200 is formed to have a polygonal shape as viewed in the x direction (see FIG. 19). The mounting bracket 200 has first to fourth mounting faces 215 to 218 and a front mounting face 220 on the front side in the z direction. The first to fourth mounting faces 215 to 218 and the front mounting face 220 are elongated rectangular flat faces extending in the x direction, and face in different directions from each other as viewed in the x direction. The first and second mounting faces 215 and 216 are positioned on respective sides of the front mounting face 220 with the front mounting face 220 interposed therebetween. The third and fourth mounting faces 217 and 218 are positioned on respective sides with the first mounting face 215, the front mounting face 220 and the second mounting face 216 interposed therebetween. The first and second mounting faces 215 and 216 face mutually opposite sides in the y direction, and face forward in the z direction. The third and fourth mounting faces 217 and 218 also face mutually opposite sides, and face forward in the z direction. The third and fourth mounting faces 217 and 218 have a smaller angle of inclination with respect to the zx plane than the first and second mounting faces 215 and 216.

Two first LED units 305 are mounted side by side in the x direction on the first mounting face 215. Likewise, two second LED units 306 are mounted side by side in the x direction on the second mounting face 216. Two third LED units 307 are mounted side by side in the x direction on the third mounting face 217. Two fourth LED units 308 are mounted side by side in the x direction on the fourth mounting face 218. On the front mounting face 220 as well, two front LED units 303 are mounted side by side in the x direction. The front LED units 303 and the first to fourth LED units 305 to 308 have the same configuration as that of the side LED units 301 described with reference to FIGS. 4 to 6. A light transmitting cover 500 protects the front LED units 303 and the first to fourth LED units 305 to 308 and transmits light emitted from these units. In the light transmitting cover 500 of the present embodiment, for example, its outer surface is formed as a light-diffusing face by blasting.

Figure 17:
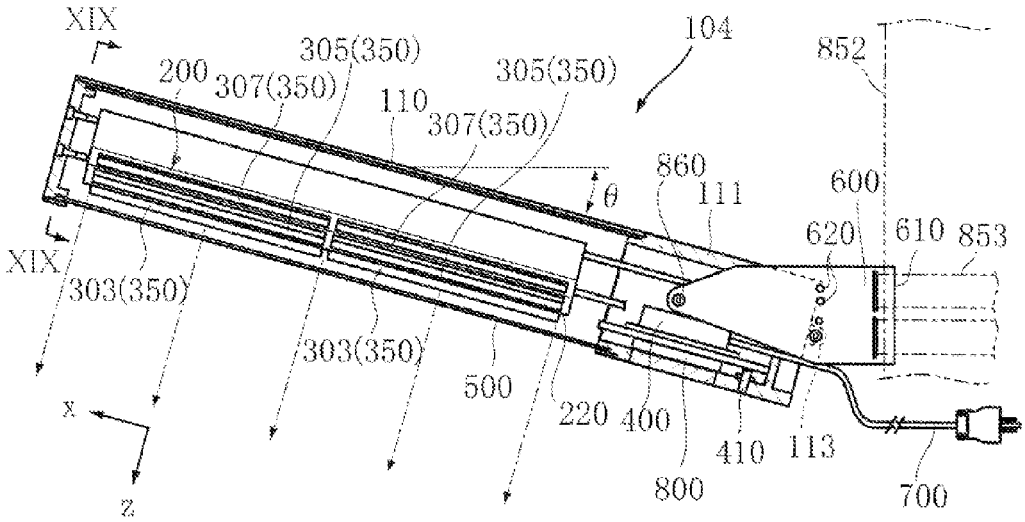
FIG. 17 is a cross-sectional view of an LED lighting device according to a fourth embodiment of the present invention.
Figure 18:
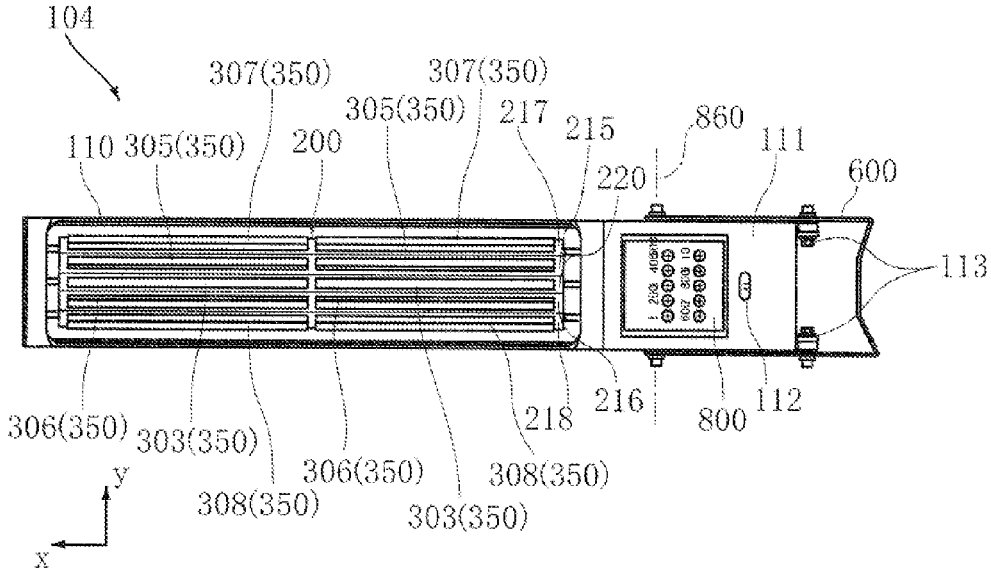
FIG. 18 is a diagram of the LED lighting device according to the fourth embodiment of the present invention as viewed from the front side thereof.
Figure 19:
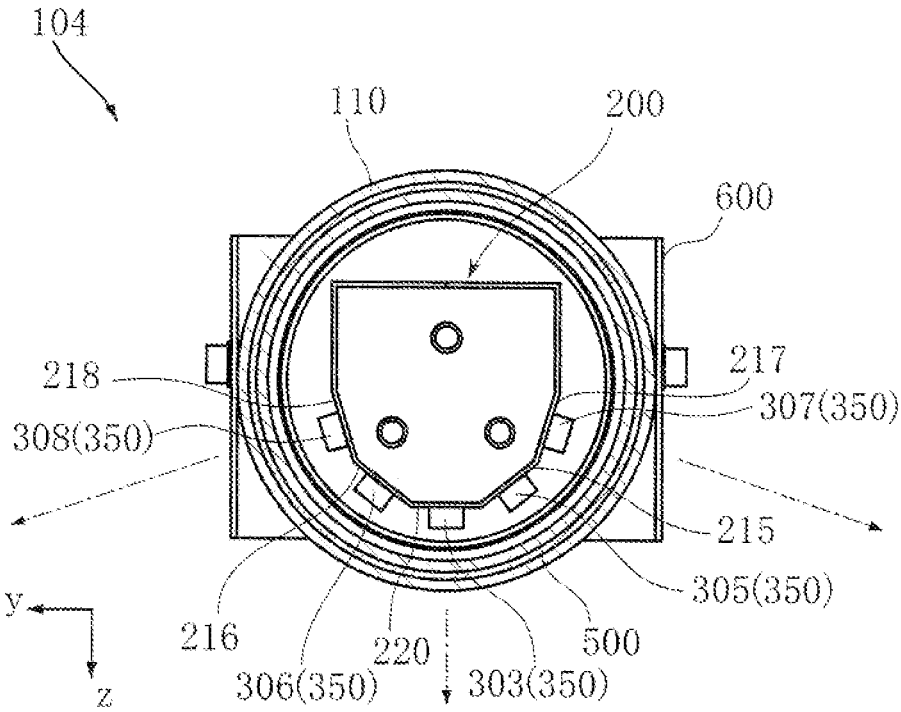
FIG. 19 is a cross-sectional view taken along the line XIX-XIX of FIG. 17.

As shown in FIGS. 17 and 18, the support bracket 110 of the present embodiment has a cylindrical portion 111. The cylindrical portion 111 forms a base side portion of the support bracket 110. A power source unit 400 is housed in the cylindrical portion 111. An illuminance sensor 410 is attached to the cylindrical portion 111 and an opening 112 is formed in the cylindrical portion 111. The illuminance sensor 410 measures the external illuminance through the opening 112. The illuminance sensor 410 outputs a signal corresponding to the external illuminance. The illuminance signal is transmitted to the power source unit 900. A lighting control operation unit 800 is housed in the cylindrical portion 111. The lighting control operation unit 800 can be operated while an openable and closeable cover (not shown) is open.

An attachment bracket 600 holds the support bracket 110 in such a manner that the support bracket 110 can rotate about a spindle 860 extending in the y direction. The support bracket 110 and the attachment bracket 600 are fixed by a fixing portion 113. The fixing portion 113 is provided in a portion on the base side relative to the spindle 860 in the support bracket 110. The fixing portion 113 has a hole (not shown), and the attachment bracket 600 has a plurality of holes 620. A screw is inserted through the hole of the fixing portion 113 and any one of the holes 620. The orientation of the support bracket 110 with respect to the attachment face 610 can be changed depending on which one of the holes 620 the screw is inserted. In other words, the angle θ between the lengthwise direction (x direction) of the support bracket 110 and the horizontal direction can be changed as appropriate.

Figure 20:
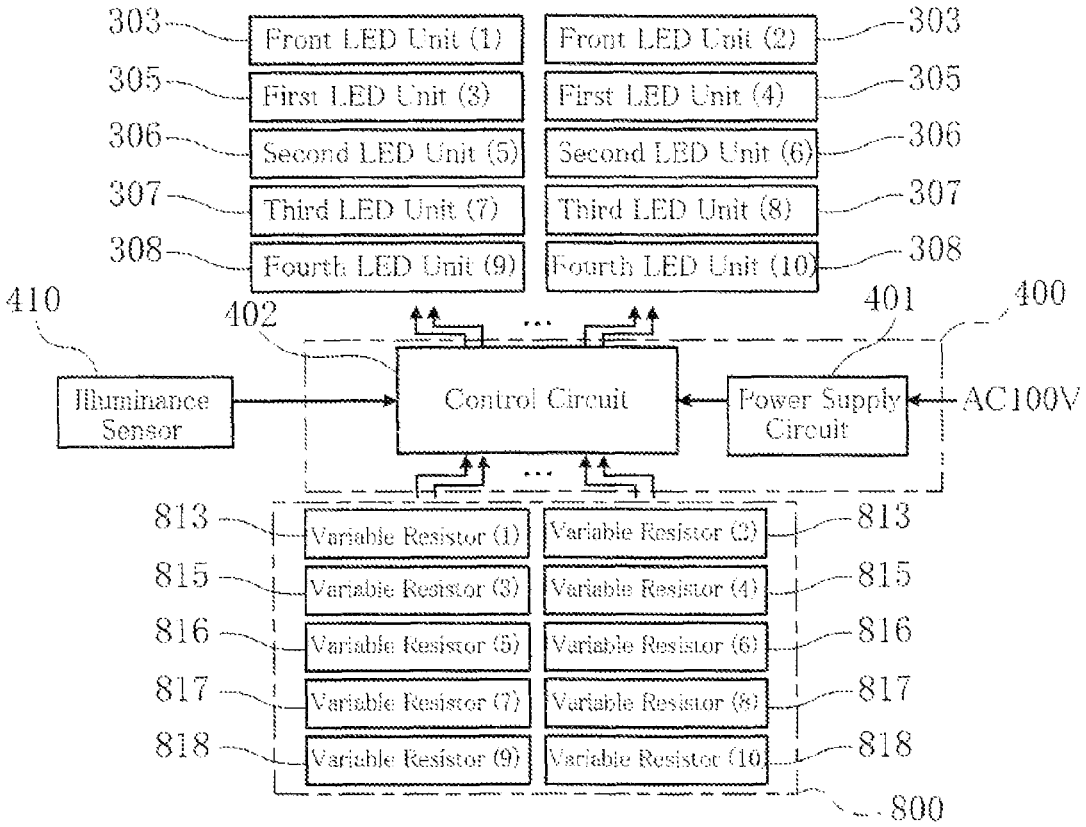
FIG. 20 is a block diagram showing an electrical configuration of the LED lighting device according to the fourth embodiment of the present invention.

As shown in FIG. 20, the power source unit 400 has a power supply circuit 401 and a control circuit 402. The lighting control operation unit 800 has a plurality of variable resistors 813 and 815 to 818. The power supply circuit 401, the illuminance sensor 410 and the variable resistors 813 and 815 to 818 are connected to input terminals of the control circuit 402. Likewise, the front LED units 303 and the first to fourth LED units 305 to 308 are connected to output terminals of the control circuit 402.

The power supply circuit 901 supplies power to the control circuit 402. The control circuit 402 supplies a driving current to each of the front LED units 303 and the first to fourth LED units 305 to 308. The control circuit 402 variably controls the driving currents by a pulse width modulation (PWM) method. The variable resistors 813 and 815 to 818 correspond to the front LED units 303 and the first to fourth LED units 305 to 308. The control circuit 402 changes each of the driving currents by changing the duty ratio of pulse width based on the resistance value of the corresponding one of the variable resistors 813 and 815 to 818. The amount of light from each of the front LED units 303 and the first to fourth LED units 305 to 308 can be independently adjusted by the power source unit 400 and the lighting control operation unit 800. The control circuit 402 also performs control to light the front LED units 303 and the first to fourth LED units 305 to 308 when the illuminance signal from the illuminance sensor 410 falls below a preset threshold value.

With this embodiment as well, it is possible to achieve a uniform illuminance distribution. For example, the amounts of light from the third and fourth LED units 307 and 308 may be increased and the amount of light from the front LED units 303 may be reduced through operation of the lighting control operation unit 800, whereby a distant region in the lengthwise direction of the road 851 and a region immediately below the LED lighting device on the road 851 can be illuminated with a relatively uniform illuminance distribution by the light from the third and fourth LED units 307 and 308.

Figure 21:
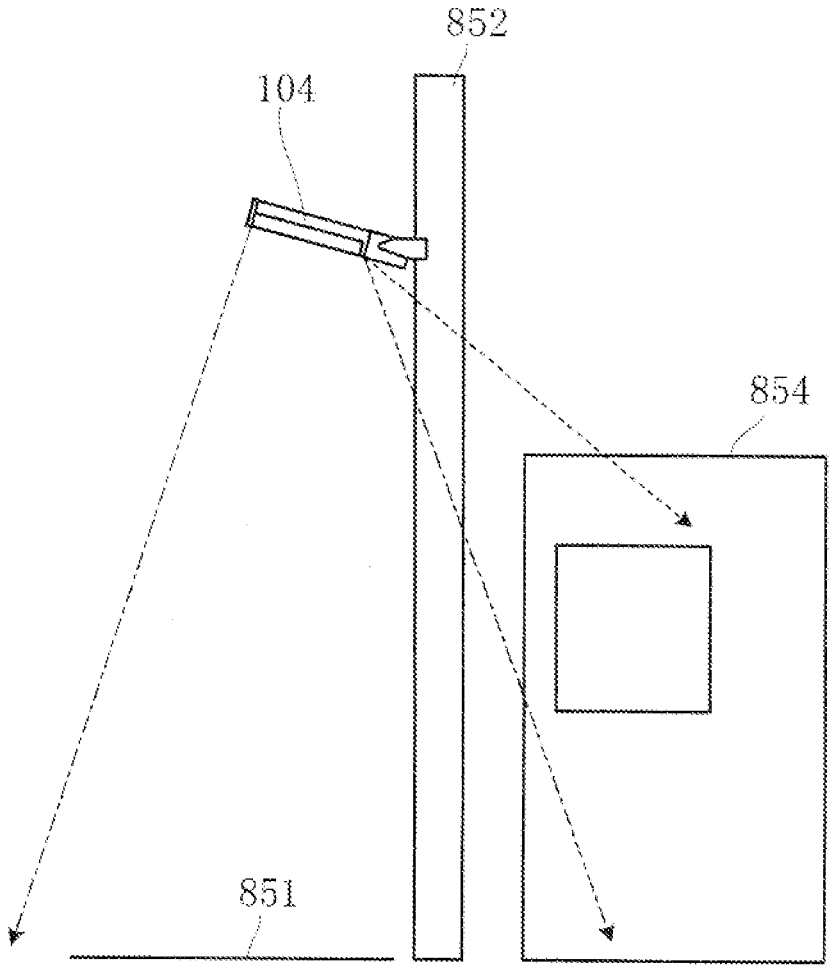
FIG. 21 is an illustrative diagram showing use of the LED lighting device according to the fourth embodiment of the present invention.

On the other hand, as shown in FIG. 21, a situation may occur in which intense light enters a house 859 adjacent to the road 851 through a window, depending on the installed state of the LED lighting device 104. In this case, the amount of light from the front LED unit 303 and the first to fourth LED units 305 to 308 on the base side may be reduced, whereby it is possible to suppress the entrance of bright light into the house 854. Such illuminance distribution adjustment is also possible by changing the angle θ (see FIG. 17).

As described above, the support bracket 110 can rotate relative to the attachment bracket 600 about the spindle 860. In addition thereto, the support bracket 110 may be configured so as to be capable of rotation about a shaft extending along the x direction, whereby the illumination level can be adjusted by adjusting the support bracket 110 in an appropriate orientation about the shaft extending along the x direction. Adjustment of the orientation of the support bracket 110 and adjustment of the amount of light may be controlled by wireless operation using a remote controller.

The light from the front LED units 303 and the first to fourth LED units 305 to 308 is diffused through the light-diffusing face of the light transmitting cover 500, whereby a more uniform illuminance distribution can be achieved. The light-diffusing face also makes the internal structure less visible, and therefore the outer appearance of the LED lighting device 104 can be improved.

FIGS. 22 to 25 show an LED lighting device according to a fifth embodiment of the present invention. An LED lighting device 105 of the present embodiment is different from that of the first embodiment described above only in that it includes four side LED units 301, two front LED units 303, and a lighting controller.

Two front LED units 303 are mounted side by side in the x direction on the front mounting face 220. Likewise, two side LED units 301 are mounted side by side in the x direction on one side mounting face 211, and two side LED units 301 are mounted side by side in the x direction on the other side mounting face 211.

Figure 22:
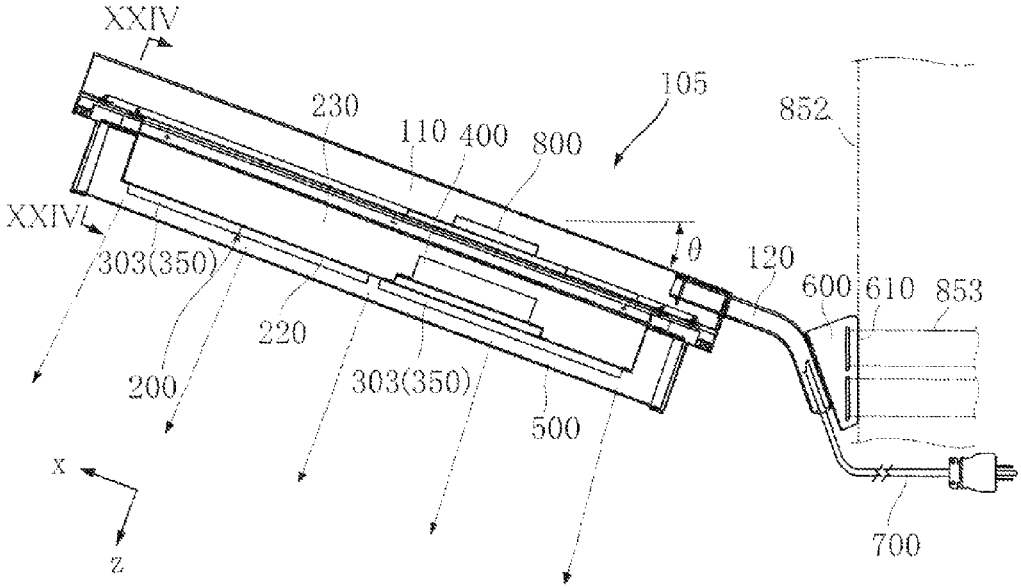
FIG. 22 is a cross-sectional view of an LED lighting device according to a fifth embodiment of the present invention.
Figure 23:
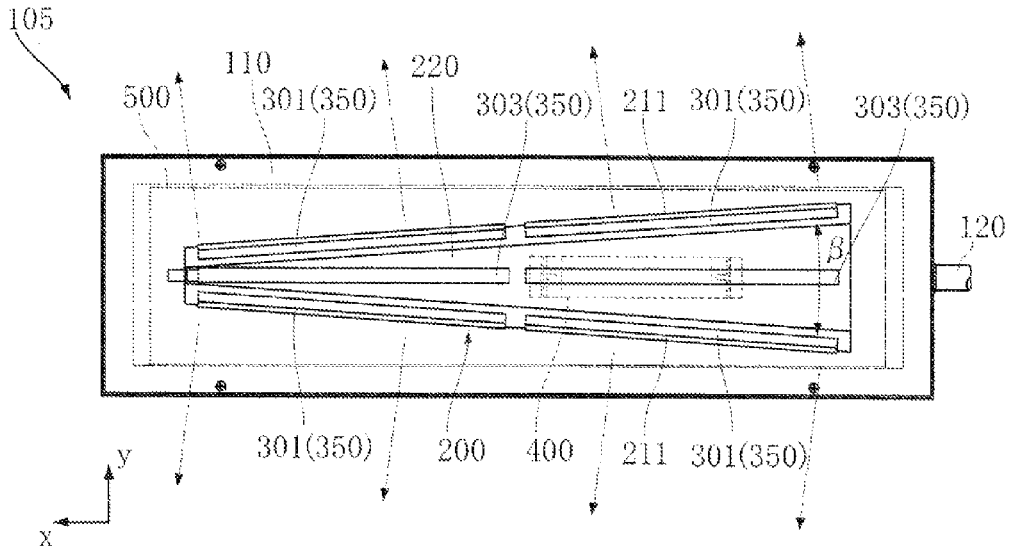
FIG. 23 is a diagram of the LED lighting device according to the fifth embodiment of the present invention as viewed from the front side thereof.
Figure 24:
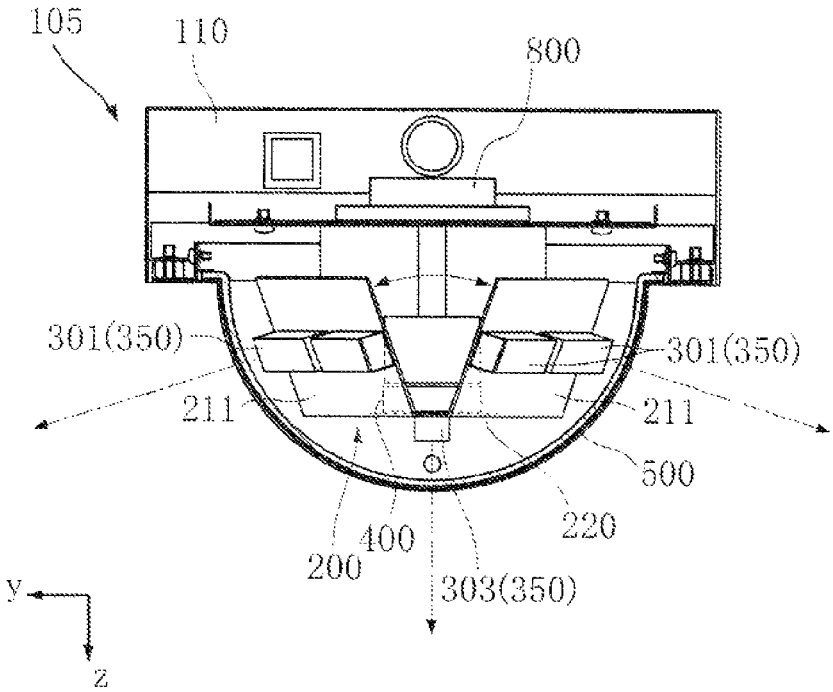
FIG. 24 is a cross-sectional view taken along the line XXIV-XXIV of FIG. 22.

As shown in FIGS. 22 and 24, a lighting control operation unit 800 is housed in a support bracket 110. The lighting control operation unit 800 can be operated while an openable and closeable cover (not shown) is open. As shown in the fourth embodiment, an attachment bracket 600 may be configured to directly hold the support bracket 110 in such a manner that the support bracket 110 can rotate about a shaft extending in the y direction. A light transmitting cover 500 may be configured to have, for example, a light-diffusing face as the outer surface.

Figure 25:
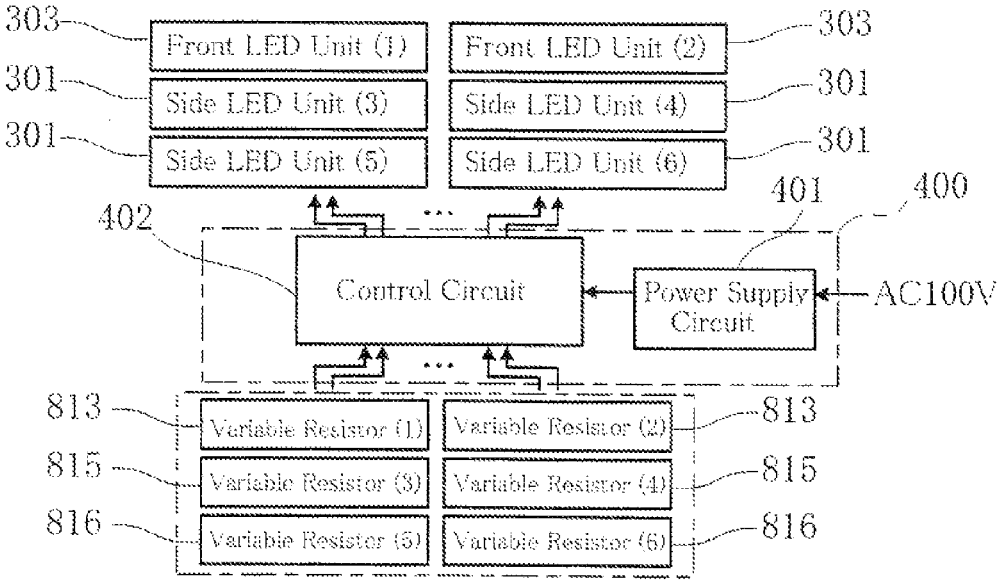
FIG. 25 is a block diagram showing an electrical configuration of the LED lighting device according to the fifth embodiment of the present invention.

As shown in FIG. 25, a power source unit 400 has a power supply circuit 401 and a control circuit 402. The lighting control operation unit 800 has a plurality of variable resistors 813, 815 and 816. The power supply circuit 401 and the variable resistors 813, 815 and 816 are connected to input terminals of the control circuit 402. The two front LED units 303 and the four side LED units 301 are connected to output terminals of the control circuit 402. The power supply circuit 401, the control circuit 402 and the variable resistors 813, 815 and 816 have the same functionality as that of the fourth embodiment. With the above-described power source unit 400 and lighting control operation unit 800 as well, it is possible to independently adjust the amount of light from each of the front LED units 303 and the side LED units 301. Accordingly, the LED lighting device 105 of the fifth embodiment can also achieve a uniform illuminance distribution. It is also possible to suppress the entrance of light into neighboring houses and the like.

FIGS. 26 to 29 show an LED lighting device according to a sixth embodiment of the present invention. An LED lighting device 106 of the present embodiment is different from that of the second embodiment in that it includes a lighting controller.

Figure 26:
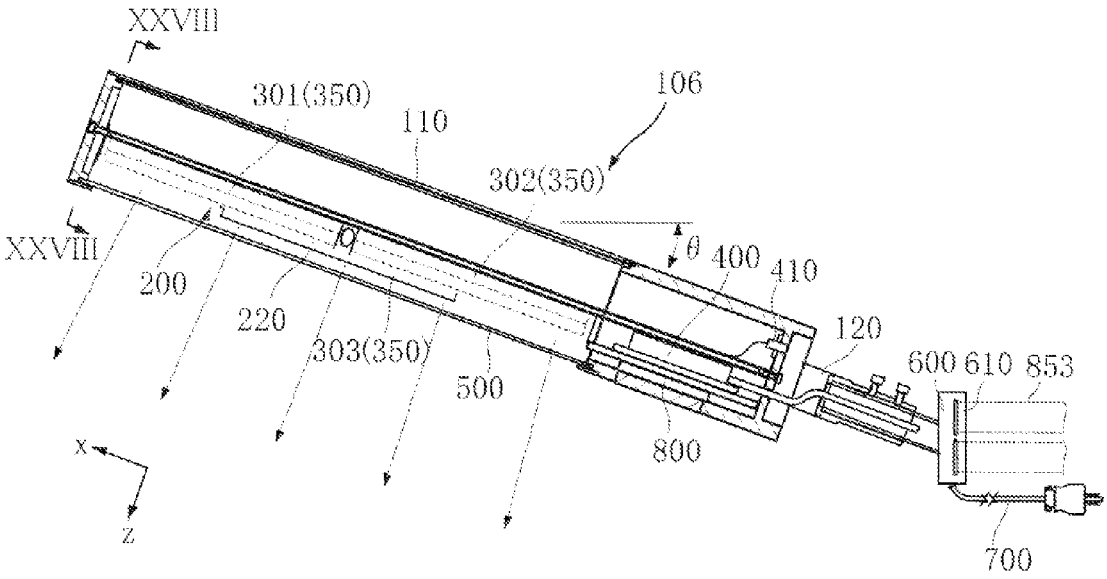
FIG. 26 is a cross-sectional view of an LED lighting device according to a sixth embodiment of the present invention.
Figure 27:
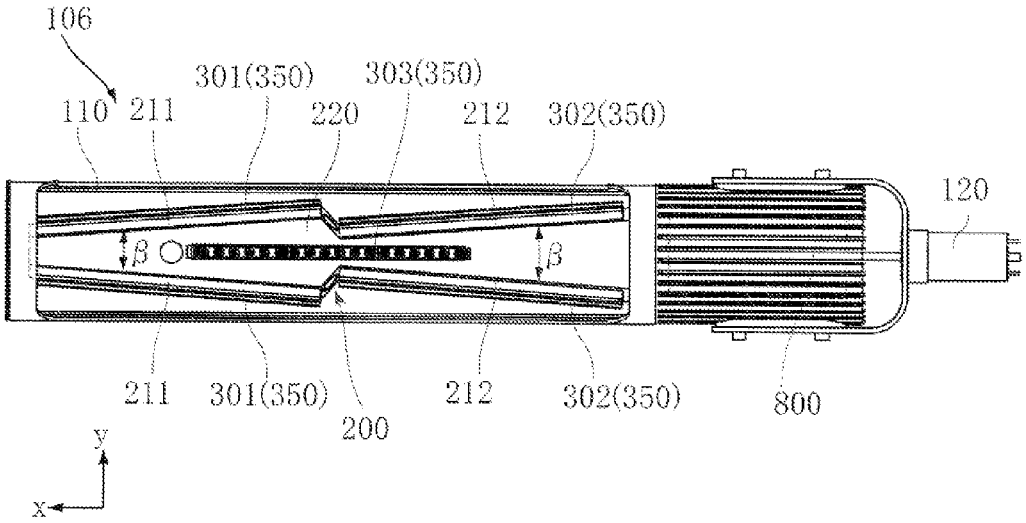
FIG. 27 is a diagram of the LED lighting device according to the sixth embodiment of the present invention as viewed from the front side thereof.
Figure 28:
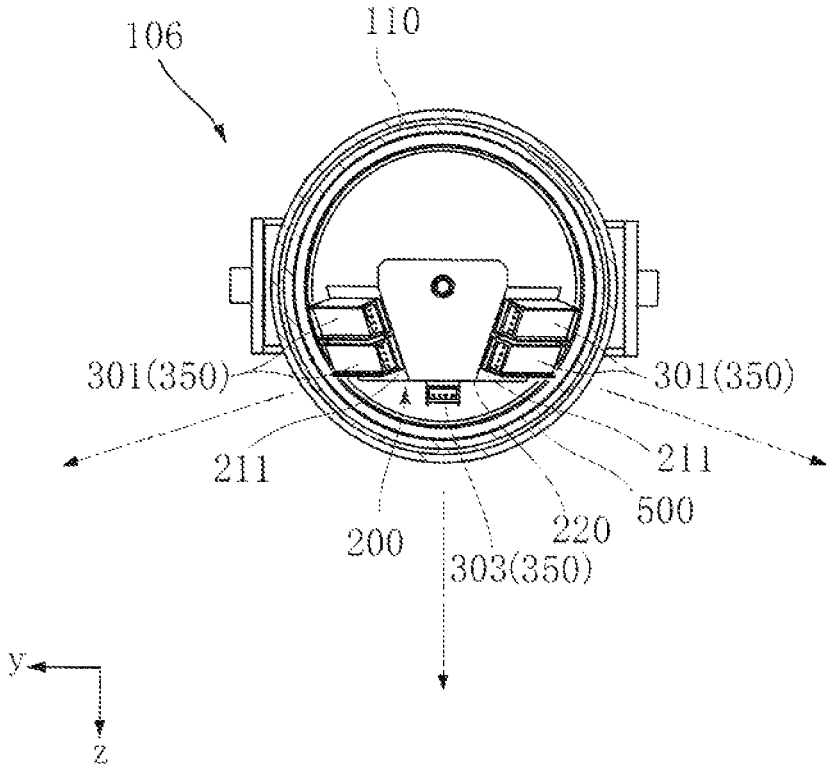
FIG. 28 is a cross-sectional view taken along the line XXVIII-XXVIII of FIG. 26.

As shown in FIGS. 26 and 28, a power source unit 400 and a lighting control operation unit 800 are housed in a cylindrical portion 111 of a support bracket 110. The lighting control operation unit 800 can be operated while an openable and closeable cover (not shown) is open. In the present embodiment as well, as shown in the fourth embodiment, an attachment bracket 600 may be configured to directly hold the support bracket 110 in such a manner that the support bracket 110 can rotate about a shaft extending in the y direction. Also, a light transmitting cover 500 may be configured to have, for example, a light-diffusing face as the outer surface.

Figure 29:
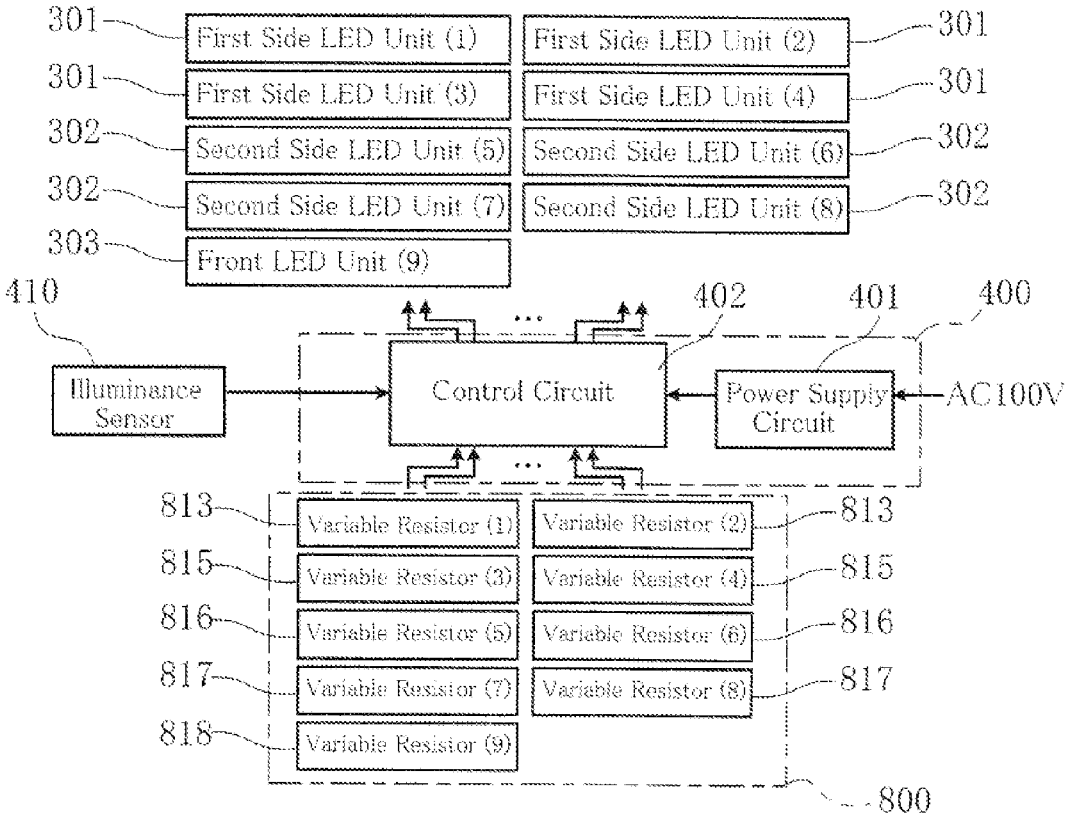
FIG. 29 is a block diagram showing an electrical configuration of the LED lighting device according to the sixth embodiment of the present invention.
Figure 30:
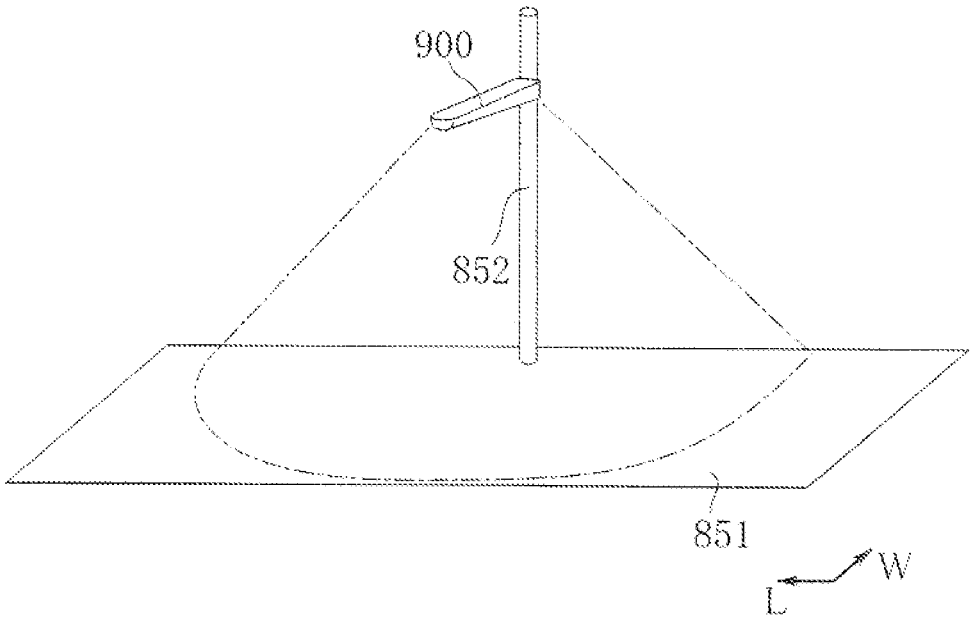
FIG. 30 PRIOR ART
FIG. 30 is an illustrative diagram showing an example of a conventional lighting device.

As shown in FIG. 29, the power source unit 400 has a power supply circuit 401 and a control circuit 402. The operation unit 800 has a plurality of variable resistors 813 and 815 to 818. The power supply circuit 401, an illuminance sensor 410 and the variable resistors 813 and 815 to 818 are connected to input terminals of the control circuit 402. Four first side LED units 301, four second side LED units 302 and a front LED unit 303 are connected to output terminals of the control circuit 402. The power supply circuit 401, the control circuit 402 and the variable resistors 813 and 815 to 818 have the same functionality as that of the fourth embodiment. With the above-described power source unit 400 and lighting control operation unit 800 as well, it is possible to independently adjust the amount of light from each of the first and second side LED units 301 and 302 and the front LED unit 303. Accordingly, the LED lighting device 106 of the sixth embodiment can also achieve a uniform illuminance distribution. It is also possible to suppress the entrance of light into neighboring houses and the like.

The LED lighting device according to the present invention is not limited to the embodiments described above. The specific configuration of each element of the LED lighting device of the present invention can be designed and changed in various ways.

The invention claimed is:

1. An LED lighting device comprising:

a plurality of LED chips; and a pair of first side mounting faces configured such that a distance between the first side mounting faces becomes shorter from a base side toward an extremity side in a first direction, that the first side mounting faces face mutually opposite sides in a second direction that is perpendicular to the first direction, and that the distance between the first side mounting faces becomes shorter from a back side toward a front side in a third direction that is perpendicular to both the first and second directions, wherein the plurality of LED chips include LED chips belonging to a pair of first side lighting groups mounted on the pair of first side mounting faces, the LED lighting device further comprising a pair of second side mounting faces configured such that a distance between the second side mounting faces becomes shorter from the base side toward the extremity side in the first direction, that the second side mounting faces face mutually opposite sides in the second direction, and that the distance between the second side mounting faces becomes shorter from the back side toward the front side in the third direction, the pair of second side mounting faces being positioned on the base side in the first direction relative to the pair of first side mounting faces, and a distance between extremities of the pair of second side mounting faces being shorter than a distance between bases of the pair of first side mounting faces, wherein the plurality of LED chips include LED chips belonging to a pair of second side lighting groups mounted on the pair of second side mounting faces.

2. The LED lighting device according to claim 1, further comprising a front mounting face that is positioned between the pair of first side mounting faces in the second direction and that faces the front side in the third direction, wherein the plurality of LED chips include LED chips belonging to a front lighting group mounted on the front mounting face.

3. The LED lighting device according to claim 2, further comprising a mounting bracket having the pair of first side mounting faces and the front mounting face.

4. The LED lighting device according to claim 3, further comprising a power source unit for lighting the plurality of LED chips, wherein the mounting bracket has a hollow portion positioned on the back side relative to the front lighting group in the third direction, and the power source unit is housed in the hollow portion.

5. The LED lighting device according to claim 4, wherein the mounting bracket is made up of a metal plate bent at interfaces between the pair of first side mounting faces and the front mounting face.

6. The LED lighting device according to claim 2, further comprising a front LED unit attached to the front mounting face, wherein the front LED unit includes the LED chips belonging to the front lighting group and a strip-shaped substrate on which the LED chips are mounted in a linear manner.

7. The LED lighting device according to claim 6, wherein the front LED unit includes a pair of reflectors disposed so as to sandwich the LED chips belonging to the front lighting group in a width direction of the substrate.

8. The LED lighting device according to claim 2, further comprising a lighting controller that, for each of the first side lighting groups, second side lighting groups and the front lighting group, adjusts an amount of light emitted from the plurality of LED chips.

9. The LED lighting device according to claim 1, further comprising a power source unit for lighting the plurality of LED chips, wherein the power source unit is disposed on the base side in the first direction relative to the pair of second side mounting faces.

10. The LED lighting device according to claim 1, further comprising a plurality of first side LED units attached to each of the first side mounting faces, wherein the first side LED units each include the LED chips belonging to the corresponding one of the first side lighting groups and a strip-shaped substrate on which the LED chips are mounted in a linear manner.

11. The LED lighting device according to claim 10, wherein the first side LED units each include a pair of reflectors disposed so as to sandwich the LED chips belonging to the corresponding one of the first side lighting groups in a width direction of the substrate.

12. The LED lighting device according to claim 1, further comprising a light transmitting cover that houses the pair of first side mounting faces and that transmits light from the plurality of LED chips.

13. The LED lighting device according to claim 12, wherein the light transmitting cover has a light-diffusing face.

14. The LED lighting device according to claim 1, further comprising an attachment face that is positioned on the base side in the first direction relative to the pair of first side mounting faces and in which a distance between the attachment face and the pair of side mounting faces becomes shorter toward the back side in the third direction.

15. The LED lighting device according to claim 1, further comprising a lighting controller that, for each of the first side lighting groups, adjusts an amount of light emitted from the plurality of LED chips.

16. The LED lighting device according to claim 1, further comprising a lighting controller that, for each of the first side lighting groups and the second side lighting groups, adjusts an amount of light emitted from the plurality of LED chips.

17. An LED lighting device comprising:

a plurality of LED chips;

a plurality of mounting faces facing different directions; and a lighting controller, wherein the plurality of LED chips are grouped so as to each belong to any one of a plurality of lighting groups respectively mounted on the plurality of mounting faces, and the lighting controller adjusts, for each of the lighting groups, an amount of light emitted from the plurality of LED chips, wherein the plurality of mounting faces include a pair of first side mounting faces, and the first side mounting faces are configured such that a distance between the first side mounting faces becomes shorter from a base side toward an extremity side in a first direction, that the first side mounting faces face mutually opposite sides in a second direction that is perpendicular to the first direction, and that the distance between the first side mounting faces becomes shorter from a back side toward a front side in a third direction that is perpendicular to both the first and second directions, and wherein the plurality of mounting faces include a pair of second side mounting faces, and the second side mounting faces are configured such that a distance between the second side mounting faces becomes shorter from the base side toward the extremity side in the first direction, that the second side mounting faces face mutually opposite sides in the second direction, and that the distance between the second side mounting faces becomes shorter from the back side toward the front side in the third direction, the pair of second side mounting faces are positioned on the base side in the first direction relative to the pair of first side mounting faces, and a distance between extremities of the pair of second side mounting faces is shorter than a distance between bases of the pair of first side mounting faces.

18. The LED lighting device according to claim 17, wherein the plurality of mounting faces include a front mounting face, and the front mounting face is positioned between the pair of first side mounting faces in the second direction and faces the front side in the third direction.

19. The LED lighting device according to claim 17, wherein at least two lighting groups from among the plurality of lighting groups are arranged in the first direction on at least one mounting face from among the plurality of mounting faces.

20. The LED lighting device according to claim 17, further comprising a plurality of LED units attached to each of the mounting faces, wherein the LED units each include a plurality of LED chips belonging to any one of the lighting groups and a strip-shaped substrate on which the LED chips are mounted in a linear manner.

21. The LED lighting device according to claim 20, wherein the LED units each include a pair of reflectors disposed so as to sandwich the plurality of LED chips belonging to any one of the lighting groups in a width direction of the substrate.

22. The LED lighting device according to claim 17, further comprising a mounting bracket having the plurality of mounting faces, a support bracket that supports the mounting bracket, and an attachment bracket that holds the support bracket, wherein the attachment bracket has an attachment face on a base side in a first direction and is configured to hold the support bracket such that an attachment orientation of the support bracket with respect to the attachment face can be changed.

23. The LED lighting device according to claim 17, further comprising a light transmitting cover that houses the plurality of mounting faces and that transmits light from the plurality of LED chips.

24. The LED lighting device according to claim 23, wherein the light transmitting cover has a light-diffusing face.

* * * * *